US009052620B2

(12) United States Patent
Sato et al.

(10) Patent No.: US 9,052,620 B2
(45) **Date of Patent: *Jun. 9, 2015**

(54) TONER, DEVELOPER, TONER CARTRIDGE, PROCESS CARTRIDGE, IMAGE FORMING APPARATUS, AND IMAGE FORMING METHOD

(75) Inventors: Shuji Sato, Kanagawa (JP); Atsushi Sugitate, Kanagawa (JP); Masaru Takahashi, Kanagawa (JP); Shotaro Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/469,642

(22) Filed: May 11, 2012

(65) Prior Publication Data

US 2013/0137030 A1 May 30, 2013

(30) Foreign Application Priority Data

Nov. 28, 2011 (JP) ..... 2011-259390

(51) Int. Cl.
*G03G 9/09* (2006.01)
*G03G 9/08* (2006.01)
*G03G 9/097* (2006.01)

(52) U.S. Cl.
CPC ..... *G03G 9/0819* (2013.01); *G03G 9/09* (2013.01); *G03G 9/09716* (2013.01); *G03G 9/0821* (2013.01); *G03G 9/09733* (2013.01)

(58) Field of Classification Search
CPC ... G03G 9/0902; G03G 9/0926; G03G 13/08; G03G 9/09733; G03G 9/09716
USPC ..... 430/108.11, 111.4, 109.4, 123.51
See application file for complete search history.

(56) References Cited

U.S. PATENT DOCUMENTS 4,976,777 A 12/1990 Ozawa et al.
5,062,886 A 11/1991 Ozawa et al.

(Continued)

FOREIGN PATENT DOCUMENTS

EP 2 047 335 B1 5/2011
JP A-62-67558 3/1987

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Oliff PLC

(57) ABSTRACT

An electrostatic charge image developing toner includes toner particles containing a binder resin and pigment particles and an external additive containing fluorine resin particles, wherein the electrostatic charge image developing toner satisfies the following expression: $2 \leq A/B \leq 100$, wherein A represents reflectance at an acceptance angle of +30° which is measured when a solid image is formed using the electrostatic charge image developing toner and the solid image is irradiated with incident light at an incidence angle of −45° by the use of a variable-angle photometer, and B represents reflectance at an acceptance angle of −30° which is measured when the solid image is irradiated with incident light at an incidence angle of −45° by the use of the variable-angle photometer.

13 Claims, 4 Drawing Sheets

(56) References Cited

U.S. PATENT DOCUMENTS

| | | | | |
|---|---|---|---|---|
| 5,198,320 | A | 3/1993 | Vreeland et al. | |
| 5,480,481 | A | 1/1996 | Setoguchi et al. | |
| 5,482,808 | A * | 1/1996 | Kondo et al. | 430/108.11 |
| 5,753,392 | A | 5/1998 | Ray et al. | |
| 5,910,388 | A | 6/1999 | Ray et al. | |
| 6,017,670 | A | 1/2000 | Hashizume et al. | |
| 6,245,140 | B1 | 6/2001 | Monden et al. | |
| 6,281,277 | B1 | 8/2001 | Ishii et al. | |
| 7,267,920 | B2 | 9/2007 | Nakazawa et al. | |
| 7,413,841 | B2 | 8/2008 | Yuasa | |
| 8,722,290 | B2 * | 5/2014 | Takahashi et al. | 430/108.1 |
| 2001/0018157 | A1 | 8/2001 | Aoki et al. | |
| 2002/0192585 | A1 | 12/2002 | Brenner et al. | |
| 2005/0214669 | A1 | 9/2005 | Hayashi et al. | |
| 2006/0093937 | A1 | 5/2006 | Grinwald | |
| 2007/0059626 | A1 | 3/2007 | Inoue et al. | |
| 2007/0072103 | A1 | 3/2007 | Kawamura et al. | |
| 2007/0141498 | A1 | 6/2007 | Umehara | |
| 2007/0207397 | A1 | 9/2007 | Julien | |
| 2008/0118280 | A1 | 5/2008 | Han et al. | |
| 2008/0131802 | A1 | 6/2008 | Mizutani et al. | |
| 2008/0182198 | A1 | 7/2008 | Kawamura et al. | |
| 2008/0193868 | A1 | 8/2008 | Schuster et al. | |
| 2008/0277490 | A1 | 11/2008 | Kinoshita et al. | |
| 2009/0029278 | A1 | 1/2009 | Op De Beeck et al. | |
| 2009/0103950 | A1 | 4/2009 | Nakayama et al. | |
| 2009/0111040 | A1 | 4/2009 | Veregin et al. | |
| 2009/0288580 | A1 | 11/2009 | Cai | |
| 2010/0183964 | A1 | 7/2010 | Yoshida et al. | |
| 2010/0330487 | A1 | 12/2010 | Veregin et al. | |
| 2011/0065034 | A1 | 3/2011 | Arima et al. | |
| 2011/0262654 | A1 | 10/2011 | Yates et al. | |
| 2011/0262858 | A1 | 10/2011 | Nair et al. | |
| 2011/0318063 | A1 * | 12/2011 | Takahashi et al. | 430/105 |
| 2011/0318682 | A1 * | 12/2011 | Takahashi et al. | 430/110.1 |
| 2011/0318683 | A1 | 12/2011 | Kadokura et al. | |
| 2013/0078562 | A1 | 3/2013 | Takahashi et al. | |

FOREIGN PATENT DOCUMENTS

| | | | |
|---|---|---|---|
| JP | A-62-100769 | | 5/1987 |
| JP | A-02-073872 | | 3/1990 |
| JP | A-6-57171 | | 3/1994 |
| JP | A-09-106094 | | 4/1997 |
| JP | A-9-302257 | | 11/1997 |
| JP | A-10-324505 | | 12/1998 |
| JP | A-2000-7941 | | 1/2000 |
| JP | A-2000-221780 | | 8/2000 |
| JP | A-2003-29444 | | 1/2003 |
| JP | A-2003-213157 | | 7/2003 |
| JP | 2004061822 | A * | 2/2004 |
| JP | 2005134738 | A * | 5/2005 |
| JP | A-2006-039475 | | 2/2006 |
| JP | A-2010-072334 | | 4/2010 |
| JP | A-2010-256613 | | 11/2010 |
| WO | WO 2006/041658 | | 4/2006 |
| WO | WO 2009/026360 | A2 | 2/2009 |

OTHER PUBLICATIONS

Briggs, John C. and Ming-Kai Tse. "The Effect of Fusing on Gloss in Electrophotography" IS&T's NIP14 International Conference on Digital Printing Technologies, Oct. 18-23, 1998, Toronto, Ontario, Canada.*

Pettersson, Torbjö rn and Andrew Fogden. "Leveling During Toner Fusing: Effects on Surface Roughness and Gloss of Printed Paper" Journal of Imaging Science and Technology 50(2): pp. 202-215, 2006.*

English language machine translation of JP 2004-061822 (Feb. 2004).*

English language machine translation of JP 2005-134738 (May 2005).*

U.S. Appl. No. 12/943,630, filed Nov. 10, 2010, first named inventor Yasuo Kadokura.

Oct. 11, 2012 Office Action issued in U.S. Appl. No. 12/943,630.

Aug. 7, 2013 Office Action issued in U.S. Appl. No. 12/943,630.

Tony Whelan, "Polymer Technology Dictionary," First Edition, 1994, p. 256, Chapman & Hall, London, UK.

Apr. 11, 2013 Office Action issued in U.S. Appl. No. 12/943,630.

May 16, 2013 Office Action issued in U.S. Appl. No. 12/955,302.

Dec. 17, 2012 Office Action issued in U.S. Appl. No. 12/907,313.

Jan. 23, 2013 Office Action issued in U.S. Appl. No. 12/955,302.

U.S. Appl. No. 12/907,313 to Takahashi et al. filed Oct. 19, 2010.

U.S. Appl. No. 12/955,302 to Takahashi et al. filed Nov. 29, 2010.

Nov. 23, 2012 Office Action issued in Australian Patent Application No. 2012200768, pp. 1-4.

Oct. 11, 2013 Notice of Allowance issued in U.S. Appl. No. 12/955,302.

Jun. 21, 2013 Office Action issued in U.S. Appl. No. 13/364,095.

Oct. 1, 2013 Office Action issued in U.S. Appl. No. 13/564,256.

Jul. 1, 2013 Office Action issued in U.S. Appl. No. 13/532,231.

Aug. 14, 2013 Office Action issued in U.S. Appl. No. 13/454,597.

Nov. 22, 2013 Office Action issued in U.S. Appl. No. 12/943,630.

U.S. Appl. No. 13/454,597 to Nakashima et al. filed Apr. 24, 2012.

U.S. Appl. No. 13/532,231 Sugitate et al. filed Jun. 25, 2012.

U.S. Appl. No. 13/564,256 Sato et al. filed Aug. 1, 2012.

U.S. Appl. No. 13/364,095 Takahashi et al. filed Feb. 1, 2012.

Dec. 4, 2013 Office Action issued in U.S. Appl. No. 13/364,095.

Dec. 19, 2013 Office Action issued in U.S. Appl. No. 13/454,597.

Jun. 3, 2014 Office Action issued in U.S. Appl. No. 12/943,630.

Jun. 26, 2014 Office Action issued in U.S. Appl. No. 13/454,597.

Mar. 27, 2014 Office Action issued in U.S. Appl. No. 13/454,597.

* cited by examiner

TONER, DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-259390 filed Nov. 28, 2011.

BACKGROUND

1. Technical Field

The present invention relates to a toner, a developer, a toner cartridge, a process cartridge, image forming apparatus, and an image forming method.

2. Related Art

Bright toners have been used to form an image having a shine such as metallic gloss.

SUMMARY

According to an aspect of the invention, there is provided an electrostatic charge image developing toner including: toner particles containing a binder resin and pigment particles; and an external additive containing fluorine resin particles, wherein the electrostatic charge image developing toner satisfies the following expression: $2 \leq A/B \leq 100$, wherein A represents reflectance at an acceptance angle of +30° which is measured when a solid image is formed using the electrostatic charge image developing toner and the solid image is irradiated with incident light at an incidence angle of −45° by the use of a variable-angle photometer, and B represents reflectance at an acceptance angle of −30° which is measured when the solid image is irradiated with incident light at an incidence angle of −45° by the use of the variable-angle photometer.

BRIEF DESCRIPTION OF THE DRAWINGS

Exemplary embodiments of the present invention will be described in detail based on the following figures, wherein.

DETAILED DESCRIPTION

Figure 1:
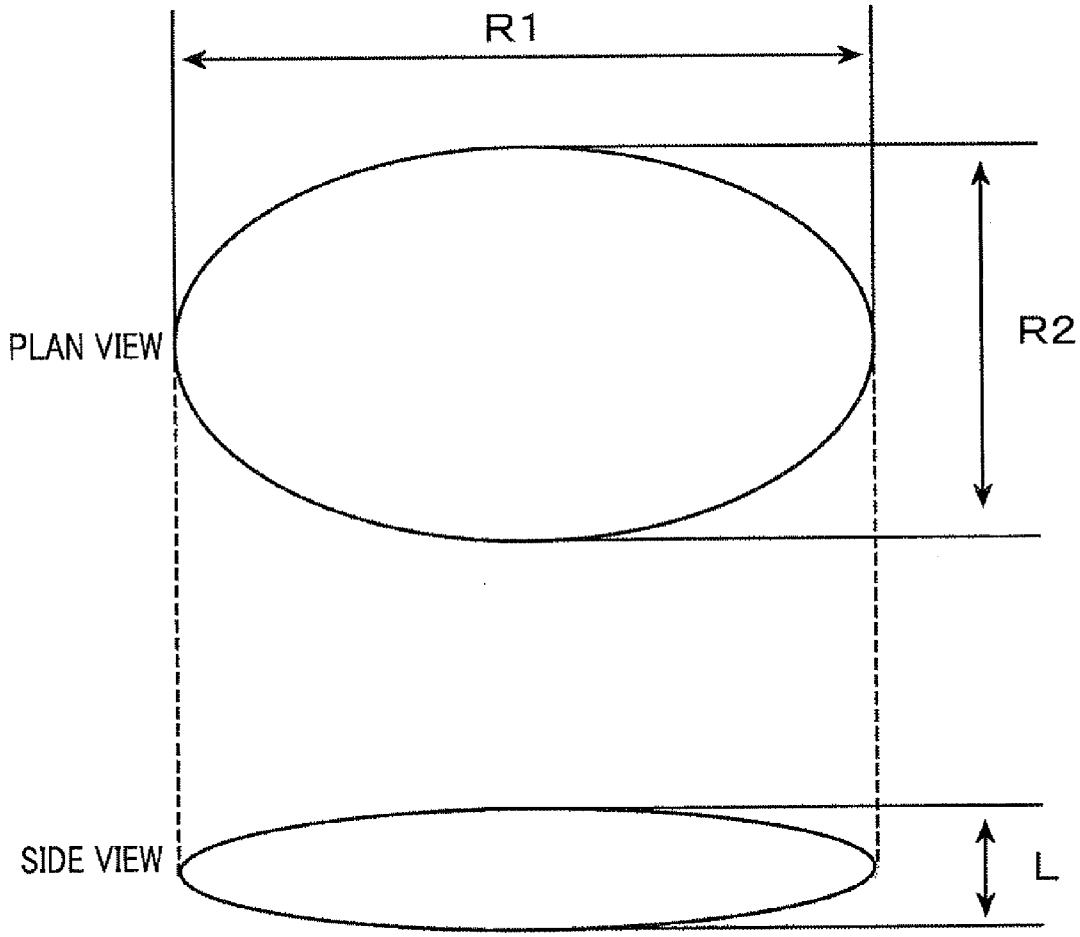
FIG. 1 is a plan view and a side view schematically illustrating a toner according to an exemplary embodiment of the invention.

An exemplary embodiment of the invention will be described in detail below. The exemplary embodiment is an example for carrying out the invention and the invention is not limited to the exemplary embodiment.

In this specification, the description, "from the lower limit to the upper limit" representing a numerical range, means "equal to or greater than the lower limit and equal to or less than the upper limit" and the description, "from the upper limit to the lower limit" representing a numerical range, means "equal to or less than the upper limit and equal to or greater than the lower limit". That is, the descriptions mean a numerical range including the upper limit and the lower limit.

1. Electrostatic Charge Image Developing Toner

An electrostatic charge image developing toner (hereinafter, also simply referred to as a "toner") according to this exemplary embodiment includes resin particles externally added to toner particles, the ratio (A/B) of the reflectance A at an acceptance angle of +30° which is measured when a solid image is formed using the electrostatic charge image developing toner and the solid image is irradiated with incident light at an incidence angle of −45° by the use of a variable-angle photometer and reflectance B at an acceptance angle of −30° is in the range of from 2 to 100, and the resin particles include fluorine resin particles.

When the ratio (A/B) is equal to or greater than 2, it means that the reflection to the opposite side (+ angle side) of the incidence side is greater than the reflection to the incidence side (− angle side) on which light is incident, that is, that irregular reflection of incident light is suppressed. When irregular reflection in which incident light is reflected in various directions is caused and the reflected light is observed with an eye, the color looks dark and dull. Accordingly, when the ratio (A/B) is less than 2 and the reflected light is visually recognized, the gloss thereof is not visible and the brilliance is poor.

On the other hand, when the ratio (A/B) is greater than 100, the viewing angle at which the reflected light may be visually recognized is excessively narrowed and the specular reflected light component is great, whereby the reflected light looks dark depending on the angle of view. It is difficult to produce the toner particles of which the ratio (A/B) is greater than 100.

Here, "brilliance" means to have a shine such as metallic gloss when an image formed with the toner is visually recognized.

The ratio (A/B) is preferably in the range of from 20 to 90 and more preferably in the range of from 40 to 80.

Measurement of Ratio (A/B) with Variable-Angle Photometer

An incidence angle and an acceptance angle will be first described. In this exemplary embodiment, the incidence angle is set to −45° at the time of measurement using the variable-angle photometer. This is because the measuring sensitivity is the highest for an image having a wide gloss range.

The acceptance angle is set to −30° and +30°, because the measuring sensitivity at the angles is the highest in evaluating a bright image and a non-bright image.

A method of measuring the ratio (A/B) will be described below.

In this exemplary embodiment, a "solid image" is first formed through the following method when measuring the ratio (A/B). A developing device, DocuCentre-III C7600, made by Fuji Xerox Co., ltd., is filled with a developer as a sample, and a solid image in which the amount of the toner is 4.5 g/cm$^2$ is formed on a recording sheet of paper (an OK top-coated+sheet of paper, made by Oji Paper Co., Ltd.) at a fixing temperature of 190° C. with a fixing pressure of 4.0 kg/cm$^2$. The "solid image" means an image with a printing coverage rate of 100%.

The image part of the formed solid image is irradiated with incident light at an incidence angle of −45° on the solid image using a spectroscopic deflection color-difference meter, GC5000L made by Nippon Denshoku Industries Co., Ltd. as a variable-angle photometer, and reflectance A at an acceptance angle of +30° and reflectance B at an acceptance angle of −30° are measured. Reflectance A and reflectance B are measured at intervals of 20 nm using light in the wavelength range of from 400 nm to 700 nm and the average reflectance at the wavelengths is calculated. The ratio (A/B) is calculated from these measurement results.

Characteristics of Toner

The toner according to this exemplary embodiment preferably satisfies the following requirements (1) and (2), from the viewpoint that the above-mentioned ratio (A/B) is satisfied.

(1) The mean circle-equivalent diameter D is greater than the average maximum thickness C of the toner particles.

(2) When a cross section taken in the thickness direction of the toner particles is observed, the number of pigment particles in which the angle of the long-axis direction of the pigment particles about the long axis direction of the toner particles in the cross section is in the range of from −30° to +30° occupies 60% or more (or about 60% or more) of the total number of pigment particles to be observed.

Average Maximum Thickness C and Mean Circle-Equivalent Diameter

A circle-equivalent diameter M is given as the flowing expression, when the projection area in a planar surface of which the projection area is the maximum is X.

$$M=(4X/\pi)^{1/2}$$

The toner particle shown in FIG. 1 is a planar toner particle in which the circle-equivalent diameter M is greater than the maximum thickness L.

As described in the requirement (1), the toner particles according to this exemplary embodiment preferably have a mean circle-equivalent diameter D greater than the average maximum thickness C. The ratio (C/D) of the average maximum diameter C to the mean circle-equivalent diameter D is more preferably in the range of from 0.01 to 0.5 and still more preferably in the range of from 0.05 to 0.1.

By setting the ratio (C/D) to be equal to or greater than 0.01, the strength of the toner particles is large to suppress the breaking thereof due to a stress at the time of forming an image and to suppress the poor charging due to the exposure of the pigment and the fogging caused thereby. On the other hand, by setting the ratio (C/D) to be equal to or less than 0.5, it is possible to achieve superior brilliance.

The average maximum thickness C and the mean circle-equivalent diameter D are measured as follows.

The toner particles are put onto a smooth surface and are dispersed uniformly through the vibration. 1000 toner particles magnified at a 1000 magnification by the use of a color laser microscope, "VK-9700 (made by Keyence Corporation), the maximum thickness C and the circle-equivalent diameter D in a plan view thereof are measured, and the arithmetic average values thereof are calculated.

The average long-axis length and the average short-axis length are similarly calculated by magnifying 1000 toner particles at a 1000 magnification by the use of the color laser microscope, "VK-9700 (made by Keyence Corporation), measuring the long-axis lengths and the short-axis lengths, and calculating the arithmetic average values thereof.

In this exemplary embodiment, the average maximum thickness C is preferably in the range of from 1 μm to 6 μm and more preferably in the range of from 2 μm to 5 μm.

The mean circle-equivalent diameter D is preferably in the range of from 5 μm to 40 μm, more preferably in the range of from 8 μm to 30 μm, and still more preferably in the range of from 10 μm to 25 μm.

When the average maximum thickness C and the mean circle-equivalent diameter D are in the above-mentioned ranges, it is possible to achieve superior brilliance, which is preferable.

Figure 2:
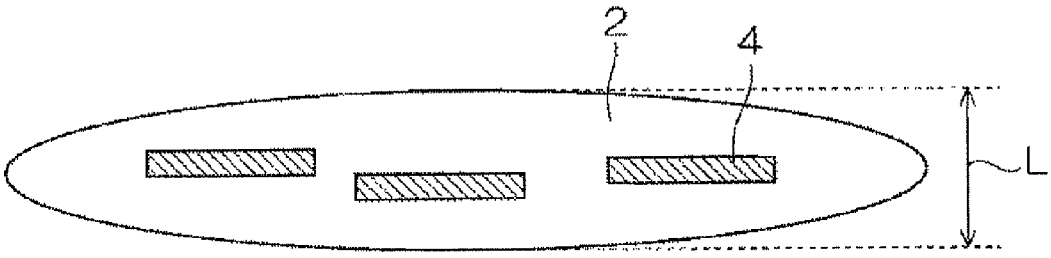
FIG. 2 is a sectional view schematically illustrating the toner according to the exemplary embodiment of the invention.

Angle Formed by Long-Axis Direction of Toner Particle in Cross Section and Log-Axis Direction of Pigment Particle The toner particle 2 shown in FIGS. 1 and 2 is a planar toner particle having a circle-equivalent diameter greater than the thickness L thereof and includes scale-like pigment particles 4.

As shown in FIG. 2, when the toner particle 2 has a planar shape having a circle-equivalent diameter greater than the thickness L thereof and the toner particles move to an image holding member, or an intermediate transfer member, or a recording medium in a developing step or a transfer step during formation of an image, the toner particles tend to move so as to cancel the electric charge thereof as much as possible and it is thus thought that the toner particles are arranged so that the attachment area is the maximum possible. That is, in a recording medium to which the toner particles are finally transferred, it is thought that the planar toner particles are arranged so that the planar surfaces thereof are parallel to the surface of the recording medium. In a fixing step during formation of an image, it is thought that the planar toner particles are arranged so that the planar surfaces thereof correspond to the surface of the recording medium due to the fixing pressure. Particularly, by externally adding fluorine resin particles thereto, it is though that the toner particles are more easily arranged so that the attachment area is the maximum.

Accordingly, it is thought that the pigment particles satisfying the requirement (2), "the angle of the long-axis direction of the pigment particles about the long axis direction of the toner particles in a cross section is in the range of from −30° to +30°", in scale-like pigment particles included in the toner particles are arranged so that the surfaces of which the area is the maximum face the surface of the recording medium. When the image formed in this way is irradiated with light, it is thought that the ratio of the pigment particles irregularly reflecting the incident light is suppressed and thus the above-mentioned range of the ratio (A/B) is achieved.

As described in (2), when the cross section of a toner particle in the thickness direction thereof is observed, the number of pigment particles in which the angle formed by the long-axis direction of the toner particle in the cross section and the long-axis direction of the pigment particles is in the range of from −30° to +30° preferably occupies 60% or more of the total number of pigment particles to be observed. In addition, the number is preferably in the range of from 70% to 95% and more preferably in the range of from 80% to 90%.

By setting the number to 60% or more, it is possible to easily achieve superior brilliance.

A method of observing a cross section of a toner particle will be described below.

Toner particles are embedded using a bisphenol A liquid epoxy resin and a curing agent to prepare a cutting sample. The cutting sample is cut at −100° C. by the use of a cutter (LEICA ultra-microtome (made by Hitachi High-Technologies Corporation) in this exemplary embodiment) using a diamond knife to prepare an observation sample. The cross sections of the toner particles are observed by magnifying the observation sample at an about 5,000 magnification by the use of a transmission electron microscope (TEM). In 1000 toner particles observed, the number of pigment particles in which the angle formed by the long-axis direction of the toner particle in the cross section and the long-axis direction of the pigment particle is in the range of from −30° to +30° is counted by the use of an image analysis software program and the ratio is calculated.

The "long-axis direction of a toner particle in a cross section" means a direction perpendicular to the thickness direction in a toner particles of which the mean circle-equivalent diameter D is greater than the average maximum thickness C. The "long-axis direction of a pigment particle" means a length direction of the pigment particle.

The volume-average particle diameter D50 of the toner particles according to this exemplary embodiment is preferably in the range of from 8 μm to 40 μm and more preferably in the range of from 10 μm to 20 μm. When the volume-average particle diameter D50 is equal to or more than 8 μm, the pigment particles on the surface of the toner particle is a little, the electric charge is high, and the fogging is prevented or a scratch is prevented on a latent image holding member. When the volume-average particle diameter D50 is equal to or smaller than 40 μm, the toner particles are stable during cleaning, thereby a scratch on the latent image holding member is prevented.

Regarding the volume-average particle diameter D50, cumulative distributions of the volume and the number are drawn from the smallest-diameter side in particle size ranges (channels) into which the particle side distribution measured by the use of a measuring instrument such as Multisizer II (made by Beckman Coulter Inc.) is divided, the particle diameter at which the accumulated value is 16% is defined as a volume D16v and a number D16p, the particle diameter at which the accumulated value is 50% is defined as a volume D50v and a number D50p, and the particle diameter at which the accumulated value is 84% is defined as a volume D84v and a number D84p. A volume-average grain size distribution index (GSDv) is calculated as $(D84v/D16v)^{1/2}$ using these definitions.

Construction of Toner

The composition of the toner according to this exemplary embodiment will be described below. In the electrostatic charge image developing toner according to this exemplary embodiment, resin particles are externally added to toner base particles. Hereinafter, components of the base particles will be first described and then the external additive will be described.

Pigment

Examples of bright pigment particles used in the toner according to this exemplary embodiment are as follows. That is, examples thereof include metal particles such as aluminum, brass, bronze, nickel, stainless steel, and zinc, coated flake-like inorganic crystalline materials, such as mica, barium sulfate, lamellar silicate, and silicate of lamellar aluminum coated with titanium oxide or yellow iron oxide, monocrystalline plate-like titanium oxide, basic carbonate, acidic bismuth oxychloride, natural guanine, flake-like glass powder, and metal-deposited flake-like glass powder. The pigment particles are not particularly limited as long as they have brilliance.

Among these, aluminum or aluminum alloy may be preferably used in view of cost and brilliance. When aluminum alloy is used, other metal elements or nonmetal elements which may be added to aluminum are not particularly limited as long as they have functions of providing metallic gloss. Examples thereof include silver, gold, platinum, nickel, chromium, tin, zinc, indium, titanium, and copper. At least one species of the simples, alloys, and mixtures thereof may be suitably used.

An example of the method of preparing the pigment particles is a method of acquiring scale-like (planar) particles with an interface between a metal or alloy layer and a separating resin layer as a boundary in a composite pigment source member having a structure in which the separating resin layer and the metal or alloy layer are sequentially stacked on the surface of a sheet-like substrate by separating the metal or alloy layer from the sheet-like substrate member and pulverizing and granulating the separated metal or alloy layer.

In this exemplary embodiment, the pigment particles are preferably flaky (planar) particles.

A flaky particle means a particle having a substantially flat plane (X-Y plane) and a substantially uniform thickness (Z). Here, the long diameter in a plan view of the flaky particle is defined as X, the short diameter thereof is defined as Y, and the thickness thereof is defined as Z.

When the long diameter in a plan view of a planar particle is X, the short diameter thereof is Y, and the thickness thereof is Z, R50 represents the 50% average particle diameter of the circle-equivalent diameter calculated from the area of the X-Y plane of the flaky particle.

The circle-equivalent diameter means the diameter of a circle when the substantially flat surface (X-Y plane) of a planar particle is assumed as a circle having the same projection area as the projection area of the particle. When the substantially flat surface (X-Y plane) of a flaky particle is polygonal, the diameter of the circle obtained by converting the projection surface of the polygon into a circle is defined as the circle-equivalent diameter of the planar particle.

In view of brilliance, R50 of a pigment particle is preferably in the range of from 4 μm to 20 μm and more preferably in the range of from 8 μm to 15 μm.

The relationship of R50 of a flaky particle and the thickness d thereof preferably satisfies R50/d>10, in view of to obtain a high brilliance. R50/d is more preferably equal to or greater than 20. The upper limit of R50/d is about 100 in view of reduction to the toner. When R50/d is equal to or smaller than 100, the pigment particle is stable during production of a toner, thereby get higher the brilliance.

The R50 may be measured using a particle image analyzer and, for example, a flow particle image analyzer FPIA-2100, FPIA-3000, and FPIA-3000S made by Sysmex Corporation may be used.

The thickness d may be measured using a SEM image.

The content of the pigment in the toner according to this exemplary embodiment is preferably in the range of from 1 part by weight to 70 parts by weight with respect to 100 parts by weight of the toner to be described later and more preferably in the range of from 5 parts by weight to 50 parts by weight.

Binder Resin

Example of the binder resin used in this exemplary embodiment include ethylene resins such as polyester, polyethylene, and polypropylene; styrene resins such as polystyrene and α-polymethylstyrene; (meth)acryl resins such as polymethyl methacrylate and polyacrylonitrile; polyamide resins, polycarbonate resins, polyether resin, and copolymer resins thereof. Among these, the polyester resin may be preferably used.

The polyester resin which may be preferably used will be described below.

The polyester resin is mainly synthesized from an acid (polyvalent carboxylic acid) component and an alcohol (polyol) component. In this exemplary embodiment, a "constituent originating from an acid" means a constituent part which is an acid component before synthesizing the polyester resin. A "constituent originating from alcohol" means a constituent part which is an alcohol component before synthesizing the polyester resin.

Constituent Originating from Acid

The constituent originating from an acid is not particularly limited, and aliphatic dicarboxylic acid and aromatic carboxylic acid may be preferably used. Examples of the aliphatic dicarboxylic acid include an oxalic acid, a malonic acid, a succinic acid, a glutaric acid, an adipic acid, a pimelic acid, a suberic acid, an azelaic acid, a sebacic acid, a 1,9-nonadicarboxylic acid, a 1,10-decanedicarboxylic acid, a 1,11-undecanedicarboxylic acid, a 1,12-dodecanedicarboxylic acid, a 1,13-tridecanedicarboxylic acid, a 1,14-tetradecanedicarboxylic acid, a 1,16-hexadecanedicarboxylic acid, and a 1,18-octadecanedicarboxylic acid, or lower alkyl esters or acid anhydrides thereof, but the constituent originating from an acid is not limited to these examples. Examples of the aromatic carboxylic acid include lower alkyl esters or acid anhydrides of aromatic carboxylic acids such as a terephthalic acid, an isophthalic acid, a phthalic anhydride, a trimellitic anhydride, a pyromellitic acid, and a naphthalene dicarboxylic acid. Examples thereof further include alicyclic carboxylic acids such as a cyclohexane dicarboxylic acid. To guarantee a superior fixing property, a trivalent or higher carboxylic acid (such as a trimellitic acid or an acid anhydride thereof) may be preferably used along with the dicarboxylic acid so as to achieve a bridged structure or a branched structure. Specific examples of the alkenyl succinic acids include a dodecenyl succinic acid, dodecyl succinic acid, stearyl succinic acid, an octyl succinic acid, and an oxanyl succinic acid.

Constituent Originating from Alcohol

The constituent originating from an alcohol is not particularly limited, but examples of an aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Alternatively, diethylene glycol, trithylene glycol, neopentyl glycol, glycerin, alicyclic diols such as cyclohexanediol, cyclohexanedimethanol, and hydrogenated bisphenol A, and aromatic diols such as ethyleneoxide adducts of bisphenol A and propyleneoxide adducts of bisphenol A may be used. To obtain a superior fixing property, a trihydric or higher alcohol (such as glycerin, trimethylol propane, and pentaerythritol) may be preferably used along with the diols so as to achieve a bridged structure or a branched structure.

Examples of the polyvalent carboxylic acid used to obtain a polyester resin in this exemplary embodiment include phthalic acid, isophthalic acid, terephthalic acid, tetrachlorophthalic acid, chlorophthalic acid, nitrophthalic acid, p-carboxyphenylacetic acid, p-phenyleneacetic acid, m-phenylene glycolic acid, p-phenylene glycolic acid, o-phenylene glycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. Examples of the polyvalent carboxylic acid other than the dicarboxylic acids include trimellitic acid, pyromellitic acid, naphthalenetricarboxylic acid, naphthalenetetracarboxylic acid, pyrenetricarboxylic acid, and pyrenetetracarboxylic acid. Materials obtained by deriving the carboxyl group of carboxylic acids to acid anhydride, acid chloride, or ester may be used.

Among these, terephthalic acid or lower esters thereof, diphenylacetic acid, and cyclohexanedicarboxylic acid may be preferably used. The lower ester means an ester of an aliphatic alcohol with a carbon number of 1 to 8.

Preferable examples of the polyol used to obtain a polyester resin in this exemplary embodiment include polytetramethylene glycol, bisphenol A, bisphenol Z, hydrogenated bisphenol A, and cyclohexanedimethanol.

A polycondensate of a hydroxycarboxylic acid may be also used.

The hydroxycarboxylic acid is a compound having both a hydroxyl group and a carboxyl group in a molecule. Examples of the hydroxycarboxylic acid include aromatic hydroxycarboxylic acid and aliphatic hydroxycarboxylic acid, but aliphatic hydroxycarboxylic acid may be preferably used.

Specific examples thereof include hydroxyheptanoic acid, hydroxyoctanoic acid, hydroxydecanoic acid, hydroxyundecanoic acid, and lactic acid. Among these, lactic acid may be preferably used.

The dicarboxylic acids and the polyols may be used singly to prepare a species of polycondensed resin, one thereof may be used singly and the other may be used in combination of two or more species, or both may be used in combinations of two or more species. When the hydroxycarboxylic acid is used to prepare a species of polycondensed resin, the hydroxycarboxylic acids may be used alone or in combination of two or more species, or may be used along with a polyvalent carboxylic acid or a polyol.

The method of preparing a polyester resin is not particularly limited, and may be prepared through the use of a general polyester polymerization method of causing an acid component and an alcohol component to react with each other. Examples thereof include a direct polycondensation method and an ester exchange method, which may be selectively used depending on the species of a monomer. The mole ratio (acid component/alcohol component) for causing the acid component and the alcohol component to react with each other varies depending on the reaction conditions and thus cannot be said for sure, but is typically about 1/1.

The preparation of the polyester resin may be performed, for example, in a polymerization temperature of from 180° C. to 230° C., and the reaction may be carried out while depressurizing the reaction system to remove water or alcohol produced during the polymerization if necessary. When a monomer is insoluble or incompatible at the reaction temperature, the polymerization reaction rate may partially increase or decrease to produce many non-colored particles. Accordingly, a high-boiling-point solvent may be added thereto as a solubilizer. The polycondensation reaction may be carried out while evaporating and removing the solubilizer. When a monomer having poor compatibility is present in the copolymerization reaction, the monomer having poor compatibility and an acid or alcohol to be polycondensed with the monomer is condensed in advance and then the resultant may be polycondensed with the main component.

Examples of the catalyst which may be used to prepare the polyester resin include alkali metal compounds such as sodium and lithium; alkaline-earth metal compounds such as magnesium and calcium; metal compounds such as zinc, manganese, antimony, titanium, tin, zirconium, and germanium; phosphite compounds, phosphate compounds, and amine compounds. Among these, tin-containing catalysts such as tin, tin formate, tin oxalate, tetraphenyltin, dibutyltin dichloride, dibutyltin oxide, and diphenyltin oxide may be preferably used.

In this exemplary embodiment, compounds having a hydrophilic polar group may be used as long as it may be copolymerized as a resin for an electrostatic charge image developing toner. Specific examples thereof include dicarboxylic compounds in which an aromatic ring is directly substituted with a sulfonyl group, such as sodium sulfonylterephthalate and sodium 3-sulfonylisophthalate when the used resin is polyester.

The glass transition temperature (Tg) of the polyester resin is preferably equal to or higher than 30° C., more preferably in the range of from 30° C. to 100° C., and still more preferably in the range of from 50° C. to 80° C.

When the glass transition temperature is in the above-mentioned range, the cohesive force of the binder resin itself in a high temperature range is excellent, the hot offset property during fixation is superior, satisfactory dissolution may be achieved, and the lowest fixing temperature does not rise easily, which is preferable.

Here, the glass transition temperature of the polyester resin means a value measured through the use of a method (DSC method) defined in ASTM D3418-82.

The glass transition temperature in this exemplary embodiment may be measured, for example, through the use of differential scanning calorimetry and, for example, by the use of "DSC-20" (made by Seiko Electronics Industrial Co., Ltd.). Specifically, about 10 mg of a sample is heated at a constant temperature-rising rate (10° C./min) and the glass transition temperature may be obtained from an intersection between the base line and the slope of an endothermic peak.

In the toner according to this exemplary embodiment, the resin other than the polyester resin is not particularly limited, but examples thereof include styrenes such as styrene, parachlorostyrene, and α-methylstyrene; acryl-based monomers such as methyl acrylate, ethyl acrylate, n-propyl acrylate, butyl acrylate, lauryl acrylate, and 2-ethylhexyl acrylate; methacryl-based monomers such as methyl methacrylate, ethyl methacrylate, n-propyl methacrylate, lauryl methacrylate, and 2-ethylhexyl methacrylate; ethylene-based unsaturated monomers such as acrylate, methacrylate, and sodium styrenesulfonate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of olefin monomers such as ethylene, propylene, and butadiene, copolymers as a combination of two or more monomers thereof, or mixtures thereof; and non-vinyl condensed resins such as an epoxy resin, a polyester resin, a polyurethane resin, a polyamide resin, a cellulose resin, and a polyether resin, or mixtures thereof with the vinyl-based resins, or graft polymers which may be obtained by polymerizing the vinyl-based monomers under coexistence thereof. These resins may be used alone or in combination of two or more species.

Release Agent

The toner according to this exemplary embodiment may include a release agent if necessary. Examples of the release agent include paraffin waxes such as low-molecular-weight polypropylene and low-molecular-weight polyethylene; silicone resins; rosins; rice waxes; and carnauba waxes.

The melting temperature of these release agents is preferably in the range of from 50° C. to 100° C. and more preferably in the range of from 60° C. to 95° C.

These release agents may be used alone or in combination of two or more species. The content of the release agent in the toner is preferably in the range of from 0.5% by weight to 15% by weight and more preferably in the range of from 1.0% by weight to 12% by weight.

Other Additives

Various components such as an internal additive, a charge controlling agent, an inorganic powder (inorganic particles), organic particles in addition to the above-mentioned components may be added to the toner according to this exemplary embodiment if necessary.

Examples of the charge controlling agent include dyes formed of complexes such as quaternary ammonium compounds, nigrosine-based compounds, aluminum, iron, and chromium and triphenylmethane-based pigments.

Widely-known inorganic particles such as silica particles, titanium oxide particles, alumina particles, cerium oxide particles, and particles obtained by hydrophobizing the surfaces thereof may be used alone or in combination of two or more species as the inorganic particles. Among these, silica particles of which the refractive index is smaller than that of the binder resin may be preferably used. The silica particles may be subjected to various types of surface treatments, and silica particles having been subjected to a surface treatment, for example, using a silane coupling agent, a titanium coupling agent, and a silicone oil may be preferably used.

External Additive

Fluorine Resin Particles

In the electrostatic charge image developing toner according to this exemplary embodiment, resin particles are externally added to toner particles and the resin particles include fluorine resin particles. By including the fluorine resin particles, a scratch on an image holding member is suppressed.

The mechanism not being clear, when the electrostatic charge image developing toner according to this exemplary embodiment includes a metal pigment or the like, the pigment may be easily exposed from the surfaces of the toner base particles and the exposed pigment may easily scratch the surface of the image holding member (photoreceptor). In addition, when the shape of the toner particles is flat, the toner particles may be easily left on the photoreceptor, thereby causing a variation in potential of the photoreceptor.

Since the fluorine resin particles are externally added to the toner base particles in this exemplary embodiment, it is thought that the fluorine resin particles appropriately form aggregates, the fluorine resin particles are appropriately fixed to uneven parts of the base particles, thereby suppressing a scratch on the photoreceptor or attachment of the toner particles to the photoreceptor.

The fluorine resin is not particularly limited, and known examples may be selected for use. Examples thereof include polytetrafluoroethylene (PTFE), tetrafluoroethylene-perfluoroalkylbiphenylether (PEA), and tetrafluoroethylene-hexafluoropropylene copolymer (FEP). Synthesis resins or a commercially-available products may be used as the fluorine resins.

Among these fluorine resins, polytetrafluoroethylene (PTFE) may be preferably used, from the viewpoint that they are not easily aggregated.

From the viewpoint that the attachment of the toner particles to the photoreceptor is suppressed, the average particle diameter of the fluorine resin particles is preferably in the range of from 50 nm to 500 nm, more preferably in the range of from 50 nm to 200 nm, and still more preferably in the range of from 60 nm to 160 nm.

Here, the "average particle diameter" may be calculated by analyzing an image, which is obtained by imaging the fluorine resin particles at a 100,000 magnification through the use of a scanning electron microscope (S-5500, made by Hitachi Ltd.), by the use of an image analyzer Luzex AP (made by Nireco Corporation). The number of fluorine resin particles sampled during the image analysis is 100. A circle-equivalent diameter converted in terms of the area is used as the average particle diameter.

The fluorine resin particles may cover the entire surface or the partial surface of the toner particles. The fluorine resin particles may cover the toner base particles of which some form an aggregate, but the fluorine resin particles preferably cover the toner base particles in a single-layered particle state.

The surface coverage of the surface of the toner base particles is preferably in the range of from 2% to 100% and more preferably in the range of from 5% to 95%. When the surface coverage is in the above-mentioned range, it is possible to effectively suppress a scratch on the image holding member. The surface coverage may be calculated by observing 50 views at a 3,000 magnification through the use of a scanning electron microscope S-4700 (made by Hitachi Ltd.) and then analyzing the observed images through the use of an area analysis tool of an image processing and analyzing software program WinROOF (made by Mitani Corporation).

The amount of the fluorine resin particles added with respect to 100 parts by weight of the toner base particles is in the range of from 0.1 part by weight to 5 parts by weight and more preferably in the range of from 1 part by weight to 3 parts by weight.

By setting the amount of the fluorine resin particles to the above-mentioned range, it is possible to effectively suppress a scratch on the photoreceptor.

Other Additives

The toner according to this exemplary embodiment may further include an external additive other than the fluorine resin if necessary.

The external additive other than the fluorine resin is not particularly limited, but examples thereof include inorganic oxide particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO. $SiO_2$, $K_2O(TiO_2)_n$, $Al_2O_3.2SiO_2$, $CaCO_3$, $MgCO_3$, $BaSO_4$, and $MgSO_4$.

Among these inorganic oxide particles, silica particles and titanium dioxide particles may be preferably used. The inorganic oxide particles are preferably subjected to a surface hydrophobizing process in advance. Through this hydrophobizing process, the powder flowability of the toner is improved and the environmental dependency of the charging and the contamination of the carrier may be more effectively improved.

Examples of the external additive other than the fluorine resin particles include polyolefin resins such as polyethylene and polypropylene; polyvinyl and polyvinylidene resins such as polystyrene, acryl resins, polyacrylonitrile, polyvinyl acetate, polyvinyl alcohol, polyvinyl butyral, polyvinyl chloride, polyvinyl carbazole, polyvinyl ether, and polyvinyl ketone; vinylchloride-vinylacetate copolymers; styrene-acrylate copolymers; straight silicone reins having an organosiloxane bond or modified products thereof; polyesters; and polycarbonates. Curable resin particles may be obtained by using a cross-linking component such as divinylbenzene at the same time as forming the resins.

Examples of the thermosetting resin include phenol resin; amino resins such as urea formaldehyde resin, melamine resin, benzoguanamine resin, urea resin, and polyamide resin; and epoxy resin.

The Other additives may be used alone or in combination of two or more species.

The amount of the other external additives added is preferably in the range of from 0.1 part by weight to 5 parts by weight in total with respect to 100 parts by weight of the toner base particles and more preferably in the range of from 0.5 part by weight to 3 parts by weight.

Method of Producing Toner

The toner according to this exemplary embodiment may be produced through known methods such as wet production methods or dry production methods, but is preferably produced through the use of the wet production methods. Examples of the wet production methods include a melt and suspension method, an emulsion aggregation method, and a dissolution and suspension method. Among these methods, the emulsion and aggregation method may be preferably used.

Here, the emulsion and aggregation method includes a method of preparing dispersions (an emulsion, a pigment dispersion, and the like) including components (a binder resin, a colorant, and the like) included in the toner, blending these dispersions to form a mixed solution, and heating the aggregated particles to the melting temperature or the glass transition temperature of the binder resin or higher (the melting temperature or higher of a crystalline resin and the glass transition temperature or higher of an amorphous resin when producing the toner including both the crystalline resin and the amorphous resin) to aggregate and coalesce the toner components.

As described above, in this exemplary embodiment, the toner having the requirements (1) and (2) may be preferably used and may be prepared, for example, through the following production method when the toner is prepared through the emulsion and aggregation method.

First, pigment particles are prepared, the pigment particles and the binder resin are dispersed and dissolved in a solvent to blend them. By dispersing the resultant in water through phase-transfer emulsification or shearing emulsification, bright pigment particles coated with resins are formed. Other compositions (such as a release agent and a shell resin) are added thereto, an aggregating agent is added thereto, and the temperature is raised to the vicinity of the glass transition temperature (Tg) of the resin while stirring the reactants, whereby aggregated particles are formed. In this step, for example, by stirring the reactants at a high stirring speed (for example, at a stirring speed of 500 rpm to 1,500 rpm) by the use of a stirring blade having two paddles and forming a laminar flow, the bright pigment particles are arranged parallel to the long-axis direction in the aggregated particles and the aggregated particles aggregate in the long-axis direction, thereby reducing the thickness of the toner particles (that is, the requirement (1) is satisfied). Finally, the solution is converted into alkali for the purpose of stabilization of particles, and then the temperature is raised to the glass transition temperature (Tg) or higher of the toner and preferably to the vicinity of Tg+20° C., thereby coalescing the aggregated particles. In this coalescence step, by coalescing the aggregated particles at a lower temperature (for example, at a temperature of 60° C. to 80° C.), the migration accompanied with the rearrangement of the materials is reduced and the orientation of the pigment particles is maintained, whereby the toner particles satisfying the requirement (2) are obtained.

The stirring speed is preferably in the range of from 650 rpm to 1,130 rpm and more preferably in the range of from 760 rpm to 870 rpm. The coalescence temperature in the coalescence step is preferably in the range of from 63° C. to 75° and more preferably in the range of from 65° C. to 70° C.

2. Developer

The toner according to this exemplary embodiment may be used as a single-component developer without any change, or may be blended with a carrier and may be used as a two-component developer.

The carrier which may be used as a two-component developer is not particularly limited and known carriers may be used. Examples thereof include magnetic metals such as iron oxide, nickel, and cobalt, magnetic oxides such as ferrite and magnetite, resin-coated carriers having a resin coating layer on the surfaces of cores, and magnetic dispersed carriers. Resin-coated carriers in which conductive material or the like is dispersed in a matrix resin may be also used.

Examples of the coating resin and the matrix resin used in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylate copolymer, straight silicone resin having an organosiloxane bond or modified products thereof, fluorine resin, polyester, polycarbonate, phenol resin, and epoxy resin. The coating resin and the matrix resin are not limited to these examples.

Examples of the conductive material include metals such as gold, silver, and copper, carbon black, titanium oxide, zinc oxide, barium sulfide, aluminum borate, potassium titanate, and tin oxide, but the conductive material is not limited to these examples.

Examples of the core of the carrier include magnetic metals such as iron, nickel, and cobalt, magnetic oxides such as ferrite and magnetite, and glass beads. Among these, the magnetic materials may be preferably used to use the carrier in a magnetic brush method. The volume-average particle diameter of the core is preferably in the range of from 10 μm to 500 μm and more preferably in the range of from 30 μm to 100 μm.

An example of the method of coating the surface of the core of the carrier with a resin is a method using a coating layer forming solution in which the coating resin and various additives if necessary are dissolved in an appropriate solvent. The solvent is not particularly limited and may be appropriately selected in consideration of the coating resin to be used, the application property, and the like.

Specific examples of the resin coating method include a dipping method of dipping the cores of the carrier in the coating layer forming solution, a spray method of spraying the coating layer forming solution to the surfaces of the cores of the carrier, a fluidized bed method of spraying the coating layer forming solution to the cores of the carrier in a state where the cores are made to float by the use of an air flow, and a kneader and coater method of blending the cores of the carrier and the coating layer forming solution in a kneader and coater to remove the solvent.

The blending ratio (weight ratio) of the toner according to this exemplary embodiment and the carrier in the two-component developer is preferably in the toner:carrier range of from 1:100 to 30:100 and more preferably in the range of from 3:100 to 20:100.

3. Image Forming Apparatus

An image forming apparatus according to this exemplary embodiment includes an image holding member; a charging unit that charges a surface of the image holding member; a latent image forming unit that forms an electrostatic latent image on the surface of the image holding member; a developing unit that develops the electrostatic latent image formed on the surface of the image holding member with a developer to form a toner image; and a transfer unit that transfers the developed toner image to a transfer medium, wherein the developer is the electrostatic charge image developing developer according to this exemplary embodiment.

Figure 3:
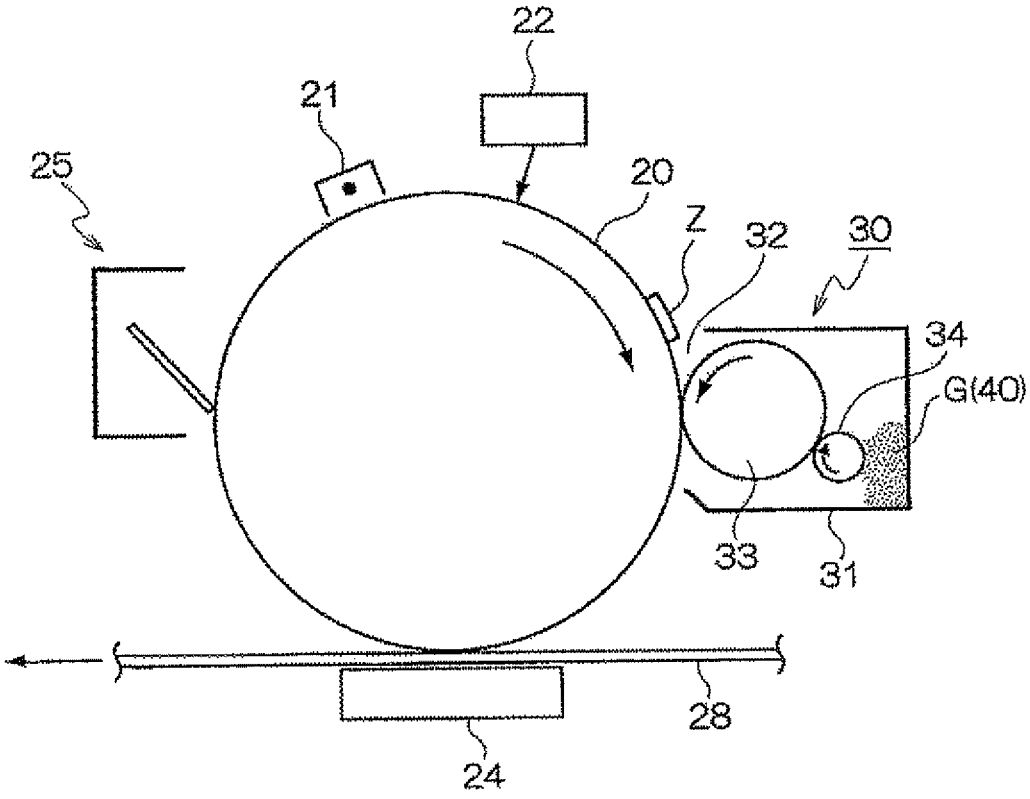
FIG. 3 is a diagram schematically illustrating the configuration of an image forming apparatus according to an exemplary embodiment of the invention.

FIG. 3 is a diagram schematically illustrating the configuration of an image forming apparatus including a developing device to which the toner according to this exemplary embodiment is applied.

In the drawing, the image forming apparatus according to this exemplary embodiment includes a photoreceptor drum 20 as an image holding member that rotates in a predetermined direction, and a charging device 21 charging the photoreceptor drum 20, an exposing device 22 as a latent image forming device forming an electrostatic latent image Z on the photoreceptor drum 20, a developing device 30 visualizing the electrostatic latent image Z formed on the photoreceptor drum 20, a transfer device 24 transferring the visualized toner image on the photoreceptor drum 20 to a recording sheet 28 as a transfer medium, and a cleaning device 25 cleaning the toner remaining on the photoreceptor drum 20 are sequentially arranged around the photoreceptor drum 20.

In this exemplary embodiment, as shown in FIG. 3, the developing device 30 includes a developing housing 31 containing a developer G including a toner 40. A developing aperture 32 is formed in the developing housing 31 to face the photoreceptor drum 20, a developing roll (developing electrode) 33 as a toner holding member is disposed in the developing aperture 32, and a developing electric field is formed in a developing area between the photoreceptor drum 20 and the developing roll 33 by applying a predetermined developing bias to the developing roll 33. A charge injecting roll (injection electrode) 34 as a charge injecting member is disposed in the developing housing 31 to face the developing roll 33. Particularly, in this exemplary embodiment, the charge injecting roll 34 is also used as a toner supply roll supplying the toner 40 to the developing roll 33.

Here, the rotation direction of the charge injecting roll 34 may be arbitrarily selected, but it is preferable in consideration of the toner supply property and the charge injection property that the charge injecting roll 34 rotate in the part facing the developing roll 33 in the same direction and with a peripheral speed difference (for example, 1.5 multiples or more), the toner 40 be interposed between the charge injecting roll 34 and the developing roll 33, and electric charge be injected by frictional contact.

The operation of the image forming apparatus according to this exemplary embodiment will be described below.

When an image forming process is started, the surface of the photoreceptor drum 20 is first charged by the charging device 21, the exposing device 22 forms an electrostatic latent image Z on the charged surface of the photoreceptor drum 20, and the developing device 30 visualizes the electrostatic latent image Z as a toner image. Thereafter, the toner image on the photoreceptor drum 20 is transported to a transfer part and the transfer device 24 transfers the toner image on the photoreceptor drum 20 to a recording sheet 28 as a transfer medium in an electrostatic manner. The toner remaining on the photoreceptor drum 20 is cleaned by the cleaning device 25. Thereafter, the toner image on the recording medium 28 is fixed by a fixing device not shown in the drawing, whereby an image is obtained.

Process Cartridge and Toner Cartridge

A process cartridge according to this exemplary embodiment includes an image holding member; and a developing unit that develops an electrostatic latent image formed on a surface of the image holding member with a developer to form a toner image, wherein the developer is the electrostatic charge image developing developer according to this exemplary embodiment.

Figure 4:
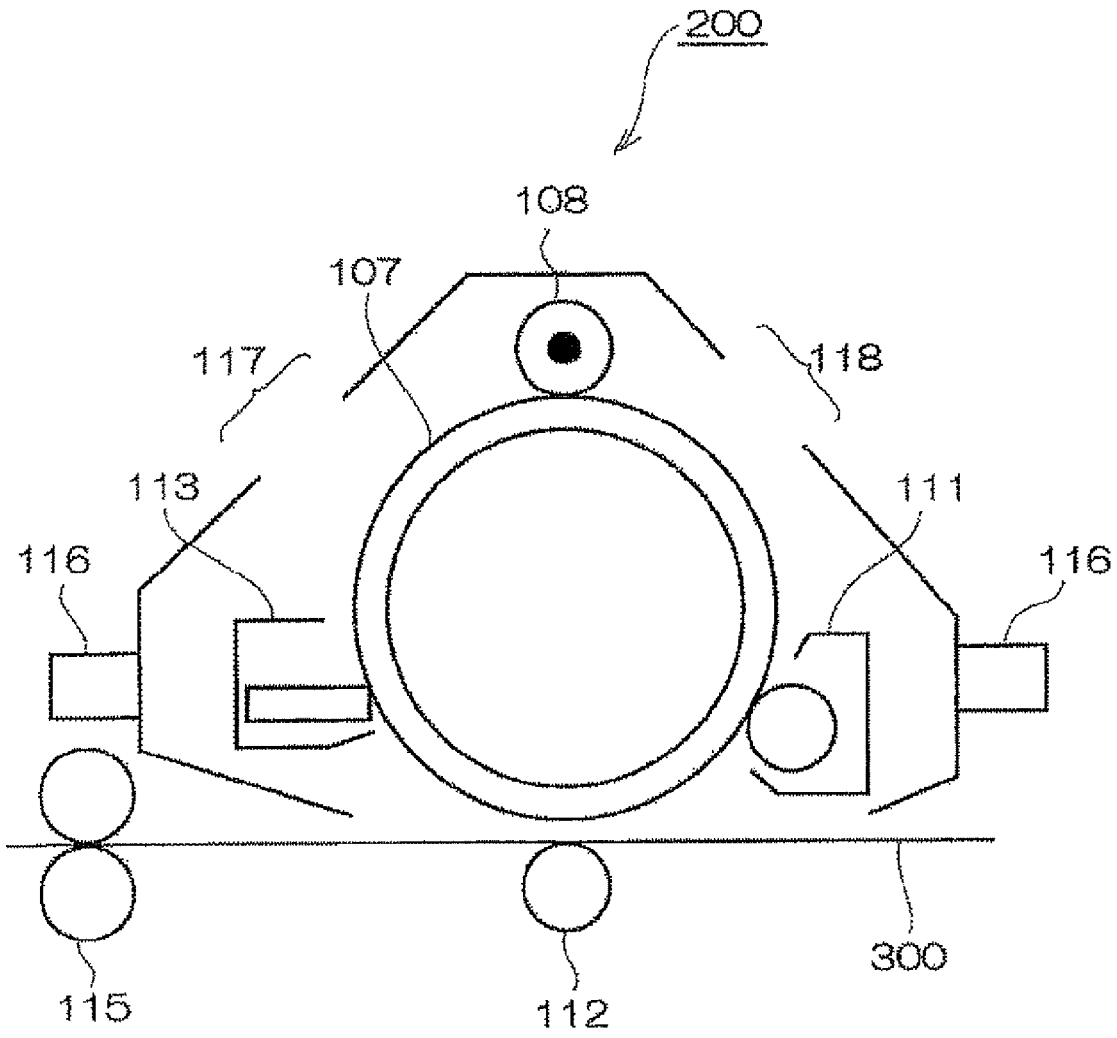
FIG. 4 is a diagram schematically illustrating the configuration of an example of a process cartridge according to an exemplary embodiment of the invention.

FIG. 4 is a diagram schematically illustrating the configuration of a process cartridge according to this exemplary embodiment. The process cartridge according to this exemplary embodiment contains the toner according to this exemplary embodiment and includes a toner holding member holding and carrying the toner.

In the process cartridge 200 shown in FIG. 4, a charging roller 108, a developing device 111 containing the toner according to this exemplary embodiment, a photoreceptor cleaning device 113, an exposure opening 118, and an erasing exposure opening 117 are combined with a photoreceptor 107 to form a body by the use of an attachment rail 116. The process cartridge 200 is detachable from an image forming apparatus body including a transfer device 112, a fixing device 115, and other constituent parts not shown and forms the image forming apparatus along with the image forming apparatus body.

The process cartridge 200 shown in FIG. 4 includes the photoreceptor 107, the charging roller (charging device) 108, the developing device 111, the photoreceptor cleaning device 113, the exposure opening 118, and the erasing exposure opening 117, but these elements may be selectively combined. The process cartridge according to this exemplary embodiment may include at least one element selected from the group consisting of the photoreceptor 107, the charging device 108, and the photoreceptor cleaning device (the cleaning unit) 113, the exposure opening 118, and the erasing exposure opening 117, in addition to the developing device 111.

A toner cartridge will be described below. The toner cartridge according to this exemplary embodiment is detachably mounted on an image forming apparatus and contains at least a toner to be supplied to a developing unit disposed in the image forming apparatus. The above-mentioned toner according to this exemplary embodiment is used as the toner. The toner cartridge according to this exemplary embodiment has only to accommodate at least a toner and may contain, for example, a developer depending on a mechanism of the image forming apparatus.

The image forming apparatus shown in FIG. 3 is an image forming apparatus having a structure on which the toner cartridge (not shown) is detachably mounted. The developing device 30 is connected to the toner cartridge via a toner supply pipe not shown. When the toner contained in the toner cartridge becomes less, the toner cartridge may be replaced.

An image forming method according to this exemplary embodiment includes charging a surface of an image holding member; forming an electrostatic latent image on the surface of the image holding member; developing the electrostatic latent image formed on the surface of the image holding member with a developer to form a toner image; and transferring the developed toner image to a transfer medium, wherein the developer is the electrostatic charge image developing developer according to this exemplary embodiment.

EXAMPLES

This exemplary embodiment will be described in more detail with reference to examples and comparative examples, but the invention is not limited to the following examples. "parts" and "%" are based on weight, as long as differently mentioned.

EXAMPLES

Preparation of Bright Toner

Synthesis of Binder Resin

Bisphenol A ethyleneoxide adduct: 216 parts
Ethylene glycol: 38 parts
Dimethyl terephthalate: 200 parts
Dimethyl isophthalate: 20 parts
Tetrabutoxy titanate (catalyst): 0.037 part These materials are put into a two-necked flask heated and dried, nitrogen gas is put into the flask, the temperature is raised while maintaining the inert gas atmosphere and stirring the reactants, the reactants are subjected to a condensation and copolymerization reaction at 160° C. for 7 hours, the temperature is raised to 220° C. while slowly depressurizing the system to 1.3 kPa, and this state is maintained for 4 hours. The pressure is returned to the normal pressure, 9 parts of trimellitic anhydride are added thereto, the pressure is slowly lowered to 1.3 kPa again, and the resultant is maintained at 220° C. for 1 hour, whereby a binder resin is synthesized. The weight-average molecular weight of the binder resin is 40,000 and the glass transition temperature (Tg) thereof is 62° C.

Preparation of Resin Particle Dispersion

Binder Resin: 160 parts
Ethyl acetate: 233 parts
Aqueous sodium hydroxide (0.3 N): 0.1 part These materials are put into a separable flask, and the resultant is heated to 70° C. and is stirred by the use of a three-one motor (made by Shinto Scientific Co., Ltd.), whereby a resin mixture is prepared. 373 parts of ion-exchange water is slowly added to the resin mixture while stirring the resin mixture and the resultant is phase-transfer emulsified to remove the solvent, whereby a resin particle dispersion (with a solid content concentration of 30%) is obtained.

Preparation of Release Agent Dispersion

Carnauba wax (RC-160, made by To a Kasei Corporation): 50 parts
Anionic surfactant (Neogen RK, made by Dai-Ichi Kogyo Seiyaku Co., Ltd.): 1.0 part
Ion-exchange water: 200 parts These materials are blended and heated to 95° C. and are dispersed by the use of a homogenizer (ULTRA-TURRAX T50, made by TKA Co., Ltd.), and a dispersing process is performed by the use of a Manton-Gaulin homogenizer (made by Gaulin Co., Ltd.) for 360 minutes, whereby a release agent dispersion (with a solid content concentration of 20%) in which release agent particles with a volume-average particle diameter of 0.23 μm are dispersed is prepared.

Preparation of Bright Pigment Particle Dispersion

Aluminum pigment (2173EA, made by Showa Aluminum Powder K.K.): 100 parts
Anionic surfactant (Neogen R, made by Dai-Ichi Kogyo Seiyaku Co., Ltd.): 1.5 parts
Ion-exchange water: 900 parts A solvent is removed from the paste of the aluminum pigment and then these materials are blended and dispersed by the use of an emulsification disperser Cavitron (CR1010, made by Pacific Machinery & Engineering Co., Ltd.), whereby a colorant dispersion (with a solid content concentration of 10%) in which bright pigment particles (aluminum pigment) are dispersed is prepared.

Preparation of Fluorine Resin Particle 1

3,500 parts of deionized water are put into an autoclave including a stainless steel anchor stirring blade and a temperature-control jacket, the inside of the system is replaced with nitrogen gas and tetrafluoroethylene (hereinafter, referred to as "TFE") while heating the system, 1.0 part of ethane is pressed therein with the TFE, the stirring is performed at 500 rpm, and the inside temperature is maintained at 80° C. An aqueous solution in which 400 parts of ammonium persulfate are dissolved in 25 parts of deionized water is pressed therein with the TFE. The TFE is supplied so that the pressure in the vessel is constant (0.80 MPa). The temperature is controlled to 90° and the stirring speed is controlled to 550 rpm. After the stirring for 1 hour, 1 part of nitric acid is added to 500 parts of a PTFE dispersion, the precipitation is started at a stirring speed of 600 rpm, polymers and water are separated, then the resultant is stirred for 1 hour, the water is removed, and the resultant is dried, whereby Fluorine Resin Particle 1 formed of polytetrafluoroethylene is obtained. The average particle diameter of Fluorine Resin Particle 1 is 120 nm.

Fluorine Resin Particle 2

Polyvinylidene fluoride particles with a volume-average particle diameter of 0.3 μm, made by Elf Ato Chem Japan Ltd., are used as Fluorine Resin Particle 2.

Preparation of Toner 1

Resin particle dispersion: 450 parts
Release agent dispersion: 50 parts
Bright pigment particle dispersion: 21.74 parts
Nonionic surfactant (IGEPAL CA897): 1.40 parts These materials are put into a cylindrical stainless steel vessel and are dispersed and blended for 10 minutes while applying a shearing force at 4,000 rpm by the use of a homogenizer (ULTRA-TURRAX T50, made by TKA Co., Ltd.). Then, 1.86 parts of 10% aqueous nitric acid of polyaluminumchloride as an aggregating agent is slowly dropped therein, and the resultant is dispersed and blended for 15 minutes while maintaining the rotation speed of the homogenizer at 5,000 rpm, whereby a source material dispersion is obtained.

Thereafter, the source material dispersion is put into a polymerization furnace having a stirrer using a stirring blade having two paddles forming a laminar flow and a thermometer and the heating is started at a stirring rotation speed of 810 rpm by the use of a mantle heater to promote the growth of aggregated particles at 56° C. At this time, the pH of the source material dispersion is controlled within the range of from 2.2 to 3.5 with a 0.3 N nitric acid or a 1 N aqueous sodium hydroxide. The resultant is maintained within the pH range for 2 hours to form aggregated particles. At this time, the volume-average particle diameter of the aggregated particles measured using Multisizer II (with an aperture diameter of 50 μm, made by Beckman Coulter Inc.) is 14.1 μm.

100 parts of a resin particle dispersion is added thereto to attach resin particles of the binder resin to the surfaces of the aggregated particles. The temperature is additionally raised to 58° C. and the aggregated particles are arranged while checking the size and shape of the particles by the use of an optical microscope and the Multisizer II. Thereafter, the pH is raised to 8.0 and then the temperature is raised to 67.5° C., so as to coalesce the aggregated particles. After confirming that the aggregated particles are coalesced by the use of the optical microscope, the pH is lowered to 6.0 while maintaining the temperature at 67.5° C., the heating is stopped in 1 hour, and the resultant is cooled at a temperature-falling rate of 1.0° C./min. Thereafter, the resultant is sieved with meshes of 20 μm, is repeatedly washed with water, and is then dried by the use of a vacuum dryer, whereby toner particles are obtained. The volume-average particle diameter of the resultant toner particles is 15.5 μm.

1.5 parts of hydrophobic silica (RY50, made by Nippon Aerosil Co., Ltd.) and 2.0 parts of Fluorine Resin Particle 1 are blended with 100 parts of the resultant toner particles at a peripheral speed of 22 m/s by the use of a Henschel mixer for 3 minutes. Thereafter, the resultant is sieved with a vibrating sieve with apertures of 45 μm to prepare a toner. At this time, the volume-average particle diameter of Toner 1 measured using Multisizer II (with an aperture diameter of 50 μm, made by Beckman Coulter Inc.) is 15.5 μm.

Preparation of Carrier

Ferrite particles (with a volume average particle diameter of 35 μm): 100 parts
Toluene: 14 parts
Polymethyl methacrylate (with a weight-average molecular weight of 75,000): 1.6 parts
Carbon black (VXC-72, made by Cabot Japan Co., Ltd., with volume resistivity of 100 Ωcm or less): 0.12 part
Cross-linked melamine resin particles (with an average particle diameter of 0.3 μm, insoluble in toluene): 0.3 part First, the carbon black diluted with the toluene is added to the polymethyl methacrylate and the resultant is dispersed with a sand mill. Then, the above-mentioned materials other than the ferrite particles are dispersed therein with a stirrer for 10 minutes, whereby a coating layer forming solution is prepared. The coating layer forming solution and the ferrite particles are put into a vacuum deaeration kneader, is then stirred at a temperature of 60° C. for 30 minutes, and the kneader is depressurized to distill away the toluene and to form a resin coating layer, whereby a carrier is prepared.

Preparation of Developer 1

Toner 1: 36 parts
Carrier: 414 parts

These materials are put into a 2 L V-shaped blender and are stirred for 20 minutes, and the resultant is sieved with meshes of 212 μm, whereby Developer 1 is prepared.

Toners 2 to 77 and Developers 2 to 77

Toners and Developers are prepared in the same way as preparing Toner 1 and Developer 1, except that the method of producing a bright toner in Example 1 is changed as follows.

Regarding Toner 2, the stirring rotation speed in the step of promoting the growth of aggregated particles of Toner 1 is changed from 810 rpm to 770 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 69° C.

Regarding Toner 3, the stirring rotation speed in the step of promoting the growth of aggregated particles of Toner 1 is changed from 810 rpm to 860 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 65° C.

Regarding Toner 4, the stirring rotation speed in the step of promoting the growth of aggregated particles of Toner 1 is changed from 810 rpm to 770 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 69° C.

Regarding Toner 5, the stirring rotation speed in the step of promoting the growth of aggregated particles of Toner 1 is changed from 810 rpm to 860 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 65° C.

Regarding Toner 6, the stirring rotation speed in the step of promoting the growth of aggregated particles of Toner 1 is changed from 810 rpm to 750 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 70.5° C.

Regarding Toner 7, the stirring rotation speed in the step of promoting the growth of aggregated particles of Toner 1 is changed from 810 rpm to 660 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 74° C.

Regarding Toner 8, the stirring rotation speed in the step of promoting the growth of aggregated particles of Toner 1 is changed from 810 rpm to 660 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 74° C.

Regarding Toner 9, the stirring rotation speed in the step of promoting the growth of aggregated particles of Toner 1 is changed from 810 rpm to 750 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 70.5° C.

Regarding Toner 10, the stirring rotation speed in the step of promoting the growth of aggregated particles of Toner 1 is changed from 810 rpm to 900 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 64° C.

Regarding Toner 11, the stirring rotation speed in the step of promoting the growth of aggregated particles of Toner 1 is changed from 810 rpm to 1,020 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 63° C.

Regarding Toner 12, the stirring rotation speed in the step of promoting the growth of aggregated particles of Toner 1 is changed from 810 rpm to 900 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 64° C.

Regarding Toner 13, the stirring rotation speed in the step of promoting the growth of aggregated particles of Toner 1 is changed from 810 rpm to 1,020 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 63° C.

Regarding Toner 14, the stirring rotation speed in the step of promoting the growth of aggregated particles of Toner 1 is changed from 810 rpm to 640 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 76.5° C.

Regarding Toner 15, the stirring rotation speed in the step of promoting the growth of aggregated particles of Toner 1 is changed from 810 rpm to 510 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 80.5° C.

Regarding Toner 16, the stirring rotation speed in the step of promoting the growth of aggregated particles of Toner 1 is changed from 810 rpm to 510 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 80.5° C.

Regarding Toner 17, the stirring rotation speed in the step of promoting the growth of aggregated particles of Toner 1 is changed from 810 rpm to 640 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 76.5° C.

Regarding Toner 18, the stirring rotation speed in the step of promoting the growth of aggregated particles of Toner 1 is changed from 810 rpm to 1,170 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 62° C.

Regarding Toner 19, the stirring rotation speed in the step of promoting the growth of aggregated particles of Toner 1 is changed from 810 rpm to 1,400 rpm, the amount of 10% aqueous nitric acid of polyaluminum chloride added is changed to 1.75 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 61° C.

Regarding Toner 20, the stirring rotation speed in the step of promoting the growth of aggregated particles of Toner 1 is changed from 810 rpm to 1,170 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 62° C.

Regarding Toner 21, the stirring rotation speed in the step of promoting the growth of aggregated particles of Toner 1 is changed from 810 rpm to 1,400 rpm, the amount of 10% aqueous nitric acid of polyaluminum chloride added is changed to 2.0 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 61° C.

Regarding Toner 22, the stirring rotation speed in the step of promoting the growth of aggregated particles of Toner 1 is changed from 810 rpm to 770 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 69° C.

Regarding Toner 23, the stirring rotation speed in the step of promoting the growth of aggregated particles of Toner 1 is changed from 810 rpm to 860 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 65° C.

Regarding Toner 24, the stirring rotation speed in the step of promoting the growth of aggregated particles of Toner 1 is changed from 810 rpm to 770 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 69° C.

Regarding Toner 25, the stirring rotation speed in the step of promoting the growth of aggregated particles of Toner 1 is changed from 810 rpm to 860 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 65° C.

Regarding Toner 26, the stirring rotation speed in the step of promoting the growth of aggregated particles of Toner 1 is changed from 810 rpm to 770 rpm, the amount of 10% aqueous nitric acid of polyaluminum chloride added is changed to 1.7 parts, the temperature at which the aggregated particles are made to grow is changed to 59° C., the temperature after attaching the resin particles of the binder resin to the surfaces of the aggregated particles is changed to 56° C., and the temperature in the step of coalescing the aggregated particles is changed from 67.5° C. to 69° C.

Regarding Toner 27, the stirring rotation speed in the step of promoting the growth of aggregated particles of Toner 1 is changed from 810 rpm to 860 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 65° C.

Regarding Toner 28, the stirring rotation speed in the step of promoting the growth of aggregated particles of Toner 1 is changed from 810 rpm to 770 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 69° C.

Regarding Toner 29, the stirring rotation speed in the step of promoting the growth of aggregated particles of Toner 1 is changed from 810 rpm to 860 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 65° C.

Regarding Toner 30, the stirring rotation speed in the step of promoting the growth of aggregated particles of Toner 1 is changed from 810 rpm to 660 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 74° C.

Regarding Toner 31, the stirring rotation speed in the step of promoting the growth of aggregated particles of Toner 1 is changed from 810 rpm to 750 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 70.5° C.

Regarding Toner 32, the stirring rotation speed in the step of promoting the growth of aggregated particles of Toner 1 is changed from 810 rpm to 660 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 74° C.

Regarding Toner 33, the stirring rotation speed in the step of promoting the growth of aggregated particles of Toner 1 is changed from 810 rpm to 750 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 70.5° C.

Regarding Toner 34, the stirring rotation speed in the step of promoting the growth of aggregated particles of Toner 1 is changed from 810 rpm to 900 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 64° C.

Regarding Toner 35, the stirring rotation speed in the step of promoting the growth of aggregated particles of Toner 1 is changed from 810 rpm to 1,020 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 63° C.

Regarding Toner 36, the stirring rotation speed in the step of promoting the growth of aggregated particles of Toner 1 is changed from 810 rpm to 900 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 64° C.

Regarding Toner 37, the stirring rotation speed in the step of promoting the growth of aggregated particles of Toner 1 is changed from 810 rpm to 1,020 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 63° C.

Regarding Toner 38, the stirring rotation speed in the step of promoting the growth of aggregated particles of Toner 1 is changed from 810 rpm to 660 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 74° C.

Regarding Toner 39, the stirring rotation speed in the step of promoting the growth of aggregated particles of Toner 1 is changed from 810 rpm to 750 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 70.5° C.

Regarding Toner 40, the stirring rotation speed in the step of promoting the growth of aggregated particles of Toner 1 is changed from 810 rpm to 660 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 74° C.

Regarding Toner 41, the stirring rotation speed in the step of promoting the growth of aggregated particles of Toner 1 is changed from 810 rpm to 750 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 70.5° C.

Regarding Toner 42, the stirring rotation speed in the step of promoting the growth of aggregated particles of Toner 1 is changed from 810 rpm to 900 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 64° C.

Regarding Toner 43, the stirring rotation speed in the step of promoting the growth of aggregated particles of Toner 1 is changed from 810 rpm to 1,020 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 63° C.

Regarding Toner 49, the stirring rotation speed in the step of promoting the growth of aggregated particles of Toner 1 is changed from 810 rpm to 900 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 64° C.

Regarding Toner 45, the stirring rotation speed in the step of promoting the growth of aggregated particles of Toner 1 is changed from 810 rpm to 1,020 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 63° C.

Regarding Toner 46, the stirring rotation speed in the step of promoting the growth of aggregated particles of Toner 1 is changed from 810 rpm to 640 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 76.5° C.

Regarding Toner 47, the stirring rotation speed in the step of promoting the growth of aggregated particles of Toner 1 is changed from 810 rpm to 510 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 80.5° C.

Regarding Toner 48, the stirring rotation speed in the step of promoting the growth of aggregated particles of Toner 1 is changed from 810 rpm to 640 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 76.5° C.

Regarding Toner 49, the stirring rotation speed in the step of promoting the growth of aggregated particles of Toner 1 is changed from 810 rpm to 510 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 80.5° C.

Regarding Toner 50, the stirring rotation speed in the step of promoting the growth of aggregated particles of Toner 1 is changed from 810 rpm to 510 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 80.5° C.

Regarding Toner 51, the stirring rotation speed in the step of promoting the growth of aggregated particles of Toner 1 is changed from 810 rpm to 640 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 76.5° C.

Regarding Toner 52, the stirring rotation speed in the step of promoting the growth of aggregated particles of Toner 1 is changed from 810 rpm to 510 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 80.5° C.

Regarding Toner 53, the stirring rotation speed in the step of promoting the growth of aggregated particles of Toner 1 is changed from 810 rpm to 640 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 76.5° C.

Regarding Toner 54, the stirring rotation speed in the step of promoting the growth of aggregated particles of Toner 1 is changed from 810 rpm to 1,170 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 62° C.

Regarding Toner 55, the stirring rotation speed in the step of promoting the growth of aggregated particles of Toner 1 is changed from 810 rpm to 1,400 rpm, the amount of 10% aqueous nitric acid of polyaluminum chloride added is changed to 1.7 parts, the temperature at which the aggregated particles are made to grow is changed to 54° C., the temperature after attaching the resin particles of the binder resin to the surfaces of the aggregated particles is changed to 56° C., and the temperature in the step of coalescing the aggregated particles is changed from 67.5° C. to 61° C.

Regarding Toner 56, the stirring rotation speed in the step of promoting the growth of aggregated particles of Toner 1 is changed from 810 rpm to 1,170 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 62° C.

Regarding Toner 57, the stirring rotation speed in the step of promoting the growth of aggregated particles of Toner 1 is changed from 810 rpm to 1,400 rpm, the amount of 10% aqueous nitric acid of polyaluminum chloride added is changed to 1.62 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 61° C.

Regarding Toner 58, the stirring rotation speed in the step of promoting the growth of aggregated particles of Toner 1 is changed from 810 rpm to 1,170 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 62° C.

Regarding Toner 59, the stirring rotation speed in the step of promoting the growth of aggregated particles of Toner 1 is changed from 810 rpm to 1,400 rpm, the amount of 10% aqueous nitric acid of polyaluminum chloride added is changed to 2.2 parts, the temperature at which the aggregated particles are made to grow is changed to 58° C., the temperature after attaching the resin particles of the binder resin to the surfaces of the aggregated particles is changed to 60° C., and the temperature in the step of coalescing the aggregated particles is changed from 67.5° C. to 61° C.

Regarding Toner 60, the stirring rotation speed in the step of promoting the growth of aggregated particles of Toner 1 is changed from 810 rpm to 1,170 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 62° C.

Regarding Toner 61, the stirring rotation speed in the step of promoting the growth of aggregated particles of Toner 1 is changed from 810 rpm to 1,400 rpm, the amount of 10% aqueous nitric acid of polyaluminum chloride added is changed to 2.8 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 61° C.

Regarding Toner 62, the stirring rotation speed in the step of promoting the growth of aggregated particles of Toner 1 is changed from 810 rpm to 510 rpm, the amount of 10% aqueous nitric acid of polyaluminum chloride added is changed to 3.0 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 80.5° C.

Regarding Toner 63, the stirring rotation speed in the step of promoting the growth of aggregated particles of Toner 1 is changed from 810 rpm to 1,400 rpm, the amount of 10% aqueous nitric acid of polyaluminum chloride added is changed to 3.0 parts, the temperature at which the aggregated particles are made to grow is changed to 60° C., the temperature after attaching the resin particles of the binder resin to the surfaces of the aggregated particles is changed to 62° C., and the temperature in the step of coalescing the aggregated particles is changed from 67.5° C. to 61° C.

Regarding Toner 64, the stirring rotation speed in the step of promoting the growth of aggregated particles of Toner 1 is changed from 810 rpm to 510 rpm, the amount of 10% aqueous nitric acid of polyaluminum chloride added is changed to 1.6 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 80.5° C.

Regarding Toner 65, the stirring rotation speed in the step of promoting the growth of aggregated particles of Toner 1 is changed from 810 rpm to 1,400 rpm, the amount of 10% aqueous nitric acid of polyaluminum chloride added is changed to 1.6 parts, the temperature at which the aggregated particles are made to grow is changed to 52° C., the temperature after attaching the resin particles of the binder resin to the surfaces of the aggregated particles is changed to 54° C., and the temperature in the step of coalescing the aggregated particles is changed from 67.5° C. to 61° C.

Regarding Toner 66, the stirring rotation speed in the step of promoting the growth of aggregated particles of Toner 1 is changed from 810 rpm to 1,420 rpm and the temperature in the step of coalescing the aggregated particles is changed from 67.5° C. to 59° C.

Regarding Toner 67, the number of paddles in the step of promoting the growth of aggregated particles of Toner 1 is changed from two to four, the stirring rotation speed is changed from 810 rpm to 500 rpm, and the temperature in the step of coalescing the aggregated particles is changed from 67.5° C. to 90° C.

Regarding Toner 68, the amount of Fluorine Resin Particle 1 of Toner 1 added is changed from 2.0 parts to 1.1 parts.

Regarding Toner 69, the amount of Fluorine Resin Particle 1 of Toner 1 added is changed from 2.0 parts to 2.9 parts.

Regarding Toner 70, the amount of Fluorine Resin Particle 1 of Toner 1 added is changed from 2.0 parts to 0.9 part.

Regarding Toner 71, the amount of Fluorine Resin Particle 1 of Toner 1 added is changed from 2.0 parts to 3.1 parts.

Regarding Toner 72, the amount of Fluorine Resin Particle 1 of Toner 1 added is changed from 2.0 parts to 0.12 part.

Regarding Toner 73, the amount of Fluorine Resin Particle 1 of Toner 1 added is changed from 2.0 parts to 0.08 part.

Regarding Toner 74, the amount of Fluorine Resin Particle 1 of Toner 1 added is changed from 2.0 parts to 4.9 parts.

Regarding Toner 75, the amount of Fluorine Resin Particle 1 of Toner 1 added is changed from 2.0 parts to 5.1 parts.

Regarding Toner 76, Fluorine Resin Particle 1 of Toner 1 is changed to Fluorine Resin Particle 2.

Regarding Toner 77, Fluorine Resin Particle 1 of Toner 1 is not added.

Measurement

The "ratio (A/B)", the "ratio (C/D) of a mean circle-equivalent diameter D to the average maximum thickness C of the toner particles", and the "volume-average particle diameter of the toner particles" are measured as described above. The results are shown in Tables 1 and 2.

Evaluation Test

Brilliance

A solid image is formed as follows.

A developer as a sample is filled in a developing device, DocuCentre-IIT C7600 made by Fuji Xerox Co., Ltd., and a solid image of 5 cm×5 cm with an amount of toner of 4.5 g/cm$^2$ is continuously formed on 1,000 recording sheets of paper (an OK top-coated+sheet of paper, made by Oji Paper Co., Ltd.) at a fixing temperature of 190° C. with a fixing pressure of 4.0 kg/cm$^2$. The brilliance of the 1,000-th solid image is evaluated with a naked eye by the use of a color observation illumination (a natural daylight illumination) based on JIS K5600-4-3: 1999, "General Dye Test Method-Part 4: Visual Characteristics of Coated Film-Section 3: Color Comparison with Naked Eye". The feeling of granularity (the effect of brilliance brilliantly shining) and the optical effect (the variation in color depending on an angle of view) are evaluated and the evaluation result is expressed in the following levels. G2 or higher levels are actually allowable.

G4: The feeling of granularity and the optical effect are balanced.

G3: There is a slight feeling of granularity and a slight optical effect.

G2: A feeling of fogging is given.

G1: There is no feeling of granularity and no optical effect.

Scratch on Photoreceptor

A scratch on the surface of a photoreceptor after the brilliance test is carried out and an image is continuously formed on 1,000 sheets of paper is observed with a naked eye. The evaluation result is expressed in the following levels. G2 or higher levels are actually allowable.

G4: Any scratch on the surface of the photoreceptor is not observed.

G3: Any scratch on the surface of the photoreceptor is not observed but slight fogging is observed.

G2: A scratch on the surface of the photoreceptor is observed but any scratch on the printed image is not observed.

G1: A scratch on the surface of the photoreceptor is observed and a scratch on the printed image is observed.

Fogging

The fogging in a non-imaged part on 1,000 sheets of paper subjected to the brilliance test and the attachment of the toner to the surface of the photoreceptor after the image is formed on the 1,000 sheets of paper are observed with a naked eye. The evaluation result is expressed in the following levels. G2 or higher levels are actually allowable.

G4: The fogging in the printed image is not observed and the attachment of toner to the surface of the photoreceptor is not observed.

G3: The fogging in the printed image is not observed but the attachment of toner to the surface of the photoreceptor is observed.

G2: The fogging in the printed image is observed with difficulty.

G1: The fogging in the printed image is clearly observed.

The evaluation results are shown in the following tables.

TABLE 1

| | | | | | | | Result | | |
|---|---|---|---|---|---|---|---|---|---|
| | | | | D50 | Fluorine resin particle | | | Scratch on | |
| | Toner | Ratio (A/B) | Ratio (C/D) | (μm) | Type | Amount (%) | Brilliance | Photoreceptor | Fogging |
| Ex. 1 | Toner 1 | 61 | 0.074 | 15.5 | Resin Particle 1 | 2 | G4 | G4 | G4 |
| Ex. 2 | Toner 2 | 43 | 0.093 | 19.8 | Resin Particle 1 | 2 | G4 | G4 | G4 |
| Ex. 3 | Toner 3 | 79 | 0.055 | 19.9 | Resin Particle 1 | 2 | G4 | G4 | G4 |
| Ex. 4 | Toner 4 | 43 | 0.093 | 10.2 | Resin Particle 1 | 2 | G4 | G4 | G4 |
| Ex. 5 | Toner 5 | 79 | 0.055 | 10.3 | Resin Particle 1 | 2 | G4 | G4 | G4 |
| Ex. 6 | Toner 6 | 38 | 0.110 | 19.7 | Resin Particle 1 | 2 | G3 | G4 | G4 |
| Ex. 7 | Toner 7 | 22 | 0.191 | 19.8 | Resin Particle 1 | 2 | G3 | G4 | G4 |
| Ex. 8 | Toner 8 | 22 | 0.191 | 10.2 | Resin Particle 1 | 2 | G3 | G4 | G4 |
| Ex. 9 | Toner 9 | 38 | 0.110 | 10.2 | Resin Particle 1 | 2 | G3 | G4 | G4 |
| Ex. 10 | Toner 10 | 82 | 0.040 | 19.6 | Resin Particle 1 | 2 | G3 | G4 | G4 |
| Ex. 11 | Toner 11 | 87 | 0.020 | 19.7 | Resin Particle 1 | 2 | G3 | G4 | G4 |
| Ex. 12 | Toner 12 | 82 | 0.040 | 10.1 | Resin Particle 1 | 2 | G3 | G4 | G4 |
| Ex. 13 | Toner 13 | 87 | 0.020 | 10.3 | Resin Particle 1 | 2 | G3 | G4 | G4 |
| Ex. 14 | Toner 14 | 19 | 0.215 | 19.7 | Resin Particle 1 | 2 | G2 | G4 | G4 |
| Ex. 15 | Toner 15 | 3 | 0.452 | 19.9 | Resin Particle 1 | 2 | G2 | G4 | G4 |
| Ex. 16 | Toner 16 | 3 | 0.452 | 10.2 | Resin Particle 1 | 2 | G2 | G4 | G4 |
| Ex. 17 | Toner 17 | 19 | 0.215 | 10.2 | Resin Particle 1 | 2 | G2 | G4 | G4 |
| Ex. 18 | Toner 18 | 91 | 0.008 | 10.2 | Resin Particle 1 | 2 | G2 | G4 | G4 |
| Ex. 19 | Toner 19 | 98 | 0.002 | 10.2 | Resin Particle 1 | 2 | G2 | G4 | G4 |
| Ex. 20 | Toner 20 | 91 | 0.008 | 19.7 | Resin Particle 1 | 2 | G2 | G4 | G4 |
| Ex. 21 | Toner 21 | 98 | 0.002 | 19.8 | Resin Particle 1 | 2 | G2 | G4 | G4 |
| Ex. 22 | Toner 22 | 43 | 0.093 | 20.3 | Resin Particle 1 | 2 | G4 | G3 | G4 |
| Ex. 23 | Toner 23 | 79 | 0.055 | 20.2 | Resin Particle 1 | 2 | G4 | G3 | G4 |
| Ex. 24 | Toner 24 | 43 | 0.093 | 39.5 | Resin Particle 1 | 2 | G4 | G3 | G4 |
| Ex. 25 | Toner 25 | 79 | 0.055 | 39.8 | Resin Particle 1 | 2 | G4 | G3 | G4 |
| Ex. 26 | Toner 26 | 43 | 0.093 | 9.8 | Resin Particle 1 | 2 | G4 | G3 | G3 |
| Ex. 27 | Toner 27 | 79 | 0.055 | 9.8 | Resin Particle 1 | 2 | G4 | G3 | G3 |
| Ex. 28 | Toner 28 | 43 | 0.093 | 8.2 | Resin Particle 1 | 2 | G4 | G3 | G3 |
| Ex. 29 | Toner 29 | 79 | 0.055 | 8.1 | Resin Particle 1 | 2 | G4 | G3 | G3 |
| Ex. 30 | Toner 30 | 22 | 0.191 | 20.3 | Resin Particle 1 | 2 | G3 | G3 | G4 |
| Ex. 31 | Toner 31 | 38 | 0.110 | 20.6 | Resin Particle 1 | 2 | G3 | G3 | G4 |
| Ex. 32 | Toner 32 | 22 | 0.191 | 39.5 | Resin Particle 1 | 2 | G3 | G3 | G4 |
| Ex. 33 | Toner 33 | 38 | 0.110 | 39.4 | Resin Particle 1 | 2 | G3 | G3 | G4 |
| Ex. 34 | Toner 34 | 82 | 0.040 | 20.5 | Resin Particle 1 | 2 | G3 | G3 | G4 |
| Ex. 35 | Toner 35 | 87 | 0.020 | 20.4 | Resin Particle 1 | 2 | G3 | G3 | G4 |
| Ex. 36 | Toner 36 | 82 | 0.040 | 39.2 | Resin Particle 1 | 2 | G3 | G3 | G4 |
| Ex. 37 | Toner 37 | 87 | 0.020 | 39.4 | Resin Particle 1 | 2 | G3 | G3 | G4 |
| Ex. 38 | Toner 38 | 22 | 0.191 | 9.9 | Resin Particle 1 | 2 | G3 | G3 | G3 |
| Ex. 39 | Toner 39 | 38 | 0.110 | 9.8 | Resin Particle 1 | 2 | G3 | G3 | G3 |
| Ex. 40 | Toner 40 | 22 | 0.191 | 8.1 | Resin Particle 1 | 2 | G3 | G3 | G3 |
| Ex. 41 | Toner 41 | 38 | 0.110 | 8.3 | Resin Particle 1 | 2 | G3 | G3 | G3 |
| Ex. 42 | Toner 42 | 82 | 0.040 | 9.9 | Resin Particle 1 | 2 | G3 | G3 | G3 |
| Ex. 43 | Toner 43 | 87 | 0.020 | 9.7 | Resin Particle 1 | 2 | G3 | G3 | G3 |
| Ex. 44 | Toner 44 | 82 | 0.040 | 8.3 | Resin Particle 1 | 2 | G3 | G3 | G3 |

TABLE 1-continued

| | Toner | Ratio (A/B) | Ratio (C/D) | D50 (μm) | Fluorine resin particle Type | Fluorine resin particle Amount (%) | Result Brilliance | Result Scratch on Photoreceptor | Result Fogging |
|---|---|---|---|---|---|---|---|---|---|
| Ex. 45 | Toner 45 | 87 | 0.020 | 8.1 | Resin Particle 1 | 2 | G3 | G3 | G3 |
| Ex. 46 | Toner 46 | 19 | 0.215 | 20.5 | Resin Particle 1 | 2 | G2 | G3 | G4 |
| Ex. 47 | Toner 47 | 3 | 0.452 | 20.3 | Resin Particle 1 | 2 | G2 | G3 | G4 |
| Ex. 48 | Toner 48 | 19 | 0.215 | 39.5 | Resin Particle 1 | 2 | G2 | G3 | G4 |
| Ex. 49 | Toner 49 | 3 | 0.452 | 39.8 | Resin Particle 1 | 2 | G2 | G3 | G4 |
| Ex. 50 | Toner 50 | 3 | 0.452 | 9.7 | Resin Particle 1 | 2 | G2 | G3 | G3 |
| Ex. 51 | Toner 51 | 19 | 0.215 | 9.8 | Resin Particle 1 | 2 | G2 | G3 | G3 |
| Ex. 52 | Toner 52 | 3 | 0.452 | 8.2 | Resin Particle 1 | 2 | G2 | G3 | G3 |
| Ex. 53 | Toner 53 | 19 | 0.215 | 8.1 | Resin Particle 1 | 2 | G2 | G3 | G3 |
| Ex. 54 | Toner 54 | 91 | 0.008 | 9.8 | Resin Particle 1 | 2 | G2 | G3 | G3 |
| Ex. 55 | Toner 55 | 98 | 0.002 | 9.9 | Resin Particle 1 | 2 | G2 | G3 | G3 |
| Ex. 56 | Toner 56 | 91 | 0.008 | 8.3 | Resin Particle 1 | 2 | G2 | G3 | 03 |
| Ex. 57 | Toner 57 | 98 | 0.002 | 8.1 | Resin Particle 1 | 2 | G2 | G3 | G3 |
| Ex. 58 | Toner 58 | 91 | 0.008 | 20.6 | Resin Particle 1 | 2 | G2 | G3 | G4 |
| Ex. 59 | Toner 59 | 98 | 0.002 | 20.3 | Resin Particle 1 | 2 | G2 | G3 | G4 |
| Ex. 60 | Toner 60 | 91 | 0.008 | 39.1 | Resin Particle 1 | 2 | G2 | G3 | G4 |
| Ex. 61 | Toner 61 | 98 | 0.002 | 39.1 | Resin Particle 1 | 2 | G2 | G3 | G4 |
| Ex. 62 | Toner 62 | 3 | 0.452 | 40.9 | Resin Particle 1 | 2 | G2 | G2 | G4 |
| Ex. 63 | Toner 63 | 98 | 0.002 | 40.6 | Resin Particle 1 | 2 | G2 | G2 | G4 |
| Ex. 64 | Toner 64 | 3 | 0.452 | 7.7 | Resin Particle 1 | 2 | G2 | G2 | G2 |
| Ex. 65 | Toner 65 | 98 | 0.002 | 7.6 | Resin Particle 1 | 2 | G2 | G2 | G2 |
| Com. Ex. 1 | Toner 66 | 102 | 0.002 | 15.3 | Resin Particle 1 | 2 | G1 | G4 | G4 |
| Com. Ex. 2 | Toner 67 | 1.8 | 1.050 | 15.1 | Resin Particle 1 | 2 | G1 | G4 | G4 |

TABLE 2

| | Toner | Ratio (A/B) | Ratio (C/D) | D50 (μm) | Fluorine resin particle Type | Fluorine resin particle Amount (%) | Result Brilliance | Result Scratch on photoreceptor | Result Fogging |
|---|---|---|---|---|---|---|---|---|---|
| Ex. 1 | Toner 1 | 61 | 0.074 | 15.5 | Resin Particle 1 | 2 | G4 | G4 | G4 |
| Ex. 66 | Toner 68 | 61 | 0.074 | 15.5 | Resin Particle 1 | 1.1 | G4 | G4 | G4 |
| Ex. 67 | Toner 69 | 61 | 0.074 | 15.5 | Resin Particle 1 | 2.9 | G4 | G4 | G4 |
| Ex. 68 | Toner 70 | 61 | 0.074 | 15.5 | Resin Particle 1 | 0.9 | G4 | G3 | G4 |
| Ex. 69 | Toner 71 | 61 | 0.074 | 15.5 | Resin Particle 1 | 3.1 | G4 | G3 | G4 |
| Ex. 70 | Toner 72 | 61 | 0.074 | 15.5 | Resin Particle 1 | 0.12 | G4 | G3 | G4 |
| Ex. 71 | Toner 73 | 61 | 0.074 | 15.5 | Resin Particle 1 | 0.08 | G4 | G2 | G4 |
| Ex. 72 | Toner 74 | 61 | 0.074 | 15.5 | Resin Particle 1 | 4.9 | G4 | G3 | G3 |
| Ex. 73 | Toner 75 | 61 | 0.074 | 15.5 | Resin Particle 1 | 5.1 | G4 | G2 | G3 |
| Ex. 74 | Toner 76 | 61 | 0.074 | 15.5 | Resin Particle 2 | 2 | G4 | G3 | G4 |
| Com. Ex. 3 | Toner 77 | 61 | 0.074 | 15.5 | — | — | G4 | G1 | G4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin and pigment particles; and an external additive containing fluorine resin particles, wherein:

the toner particles have a mean circle-equivalent diameter D greater than an average maximum thickness C, a number of pigment particles in which an angle of a long-axis direction of the pigment particles about the long-axis direction of the toner particles in a cross section thereof is in a range of from −30° to +30° when the cross section is observed in a thickness direction of the toner particles occupies about 60% or more of a total amount of pigment particles to be observed, and the electrostatic charge image developing toner satisfies the following expression:

$$2 \leq A/B \leq 100$$

where:

A represents reflectance at an acceptance angle of +30° which is measured when a solid image is formed using the electrostatic charge image developing toner and the solid image is irradiated with incident light at an incidence angle of −45° by the use of a variable-angle photometer, and B represents reflectance at an acceptance angle of −30° which is measured when the solid image is irradiated with incident light at an incidence angle of −45° by the use of the variable-angle photometer.

2. The electrostatic charge image developing toner according to claim 1, wherein the fluorine resin particles are particles of polytetrafluoroethylene.

3. The electrostatic charge image developing toner according to claim 2, wherein an amount of the fluorine resin particles with respect to 100 parts by weight of the toner particles is in a range of from 0.1 part by weight to 5 parts by weight.

4. The electrostatic charge image developing toner according to claim 1, wherein the electrostatic charge image developing toner satisfies the following expression:

$$20 \leq A/B \leq 90.$$

5. The electrostatic charge image developing toner according to claim 1, wherein a volume-average particle diameter of the toner particles is in a range of from 8 μm to 40 μm.

6. The electrostatic charge image developing toner according to claim 1, wherein an amount of the fluorine resin particles with respect to 100 parts by weight of the toner particles is in a range of from 0.1 part by weight to 5 parts by weight.

7. An electrostatic charge image developing developer comprising the electrostatic charge image developing toner according to claim 1.

8. The electrostatic charge image developing developer according to claim 7, wherein the fluorine resin particles are particles of polytetrafluoroethylene.

9. An image forming method comprising:

charging a surface of an image holding member;

forming an electrostatic latent image on the surface of the image holding member;

developing the electrostatic latent image formed on the surface of the image holding member with a developer to form a toner image; and transferring the developed toner image to a transfer medium, wherein the developer is the electrostatic charge image developing developer according to claim 7.

10. The image forming method according to claim 9, wherein the fluorine resin particles are particles of polytetrafluoroethylene.

11. A toner cartridge comprising:

a toner accommodating chamber, wherein the toner accommodating chamber contains the electrostatic charge image developing toner according to claim 1.

12. The electrostatic charge image developing toner according to claim 1, wherein the pigment particle is a flaky pigment particle, and a relationship between an R50 of the flaky pigment particle and a thickness d of the flaky pigment particle is defined as R50/d>10.

13. An electrostatic charge image developing toner comprising:

toner particles containing a binder resin and pigment particles; and an external additive containing particles of polytetrafluoroethylene, wherein the electrostatic charge image developing toner satisfies the following expression:

$$2 \leq A/B \leq 100$$

where:

A represents reflectance at an acceptance angle of +30° which is measured when a solid image is formed using the electrostatic charge image developing toner and the solid image is irradiated with incident light at an incidence angle of −45° by the use of a variable-angle photometer, and B represents reflectance at an acceptance angle of −30° which is measured when the solid image is irradiated with incident light at an incidence angle of −45° by the use of the variable-angle photometer.

* * * * *